US009765743B2

(12) United States Patent
Schurz et al.

(10) Patent No.: US 9,765,743 B2
(45) Date of Patent: Sep. 19, 2017

(54) INJECTION VALVE

(71) Applicant: Continental Automotive GmbH, Hannover (DE)

(72) Inventors: Willibald Schurz, Pielenhofen (DE); Martin Simmet, Bad Abbach (DE); Gerd Schmutzler, Tegernheim (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 905 days.

(21) Appl. No.: 13/890,839

(22) Filed: May 9, 2013

(65) Prior Publication Data

US 2014/0000565 A1 Jan. 2, 2014

(30) Foreign Application Priority Data

May 10, 2012 (DE) ..... 10 2012 207 842

(51) Int. Cl.
*F02M 69/04* (2006.01)
*F02M 55/02* (2006.01)
(Continued)

(52) U.S. Cl.
CPC ..... *F02M 69/04* (2013.01); *F02M 51/0603* (2013.01); *F02M 55/02* (2013.01);
(Continued)

(58) Field of Classification Search
CPC ..... F02M 47/027; F02M 2200/703; F02M 47/02; F02M 2200/304; F02M 47/046; F02M 57/025; F02M 47/025; F02M 47/06; F02M 55/02; F02M 55/025; F02M 69/04; F02M 51/0603; F02M 61/08
See application file for complete search history.

(56) References Cited

U.S. PATENT DOCUMENTS 6,152,112 A * 11/2000 Coppola ..... F02M 55/02 123/468
7,225,790 B2 6/2007 Bartunek et al. ..... 123/294
(Continued)

FOREIGN PATENT DOCUMENTS

DE 10129375 A1 1/2003 ..... F02M 47/02
DE 10326707 B3 1/2005 ..... B05B 1/08
DE 102008044743 A1 3/2010 ..... F02M 47/00

*Primary Examiner* — Sizo Vilakazi
(74) *Attorney, Agent, or Firm* — Slayden Grubert Beard PLLC

(57) ABSTRACT

An injection valve may have a nozzle body with a longitudinal axis, in which a nozzle body aperture and at least one injection opening are arranged, wherein the nozzle body aperture can be coupled hydraulically to a high-pressure circuit for a fluid, at least one nozzle needle arranged in an axially movable manner in the nozzle body aperture, wherein the nozzle needle prevents fluid flow through the at least one injection opening in a closing position and allows fluid flow through the at least one injection opening outside the closing position, an actuator housing, which is designed to accommodate an actuator designed to act on the nozzle needle, and at least one fluid line, which is designed for hydraulic coupling to the high-pressure circuit for the fluid and is constructed and arranged separately from the actuator housing, and is directly coupled hydraulically to the nozzle body aperture.

10 Claims, 3 Drawing Sheets

FIG 1

(51) Int. Cl.
*F02M 51/06* (2006.01)
*F02M 61/08* (2006.01)

(52) U.S. Cl.
CPC ..... *F02M 61/08* (2013.01); *F02M 2200/03* (2013.01); *F02M 2200/40* (2013.01)

(56) References Cited

U.S. PATENT DOCUMENTS

| | | | | |
|---|---|---|---|---|
| 2004/0149265 | A1* | 8/2004 | Magel | F02M 47/027 123/446 |
| 2004/0149840 | A1 | 8/2004 | Remmels et al. | 239/584 |
| 2005/0103310 | A1* | 5/2005 | Kern | F02M 45/02 123/446 |
| 2007/0056564 | A1* | 3/2007 | Fujii | F02M 65/00 123/480 |
| 2007/0290076 | A1* | 12/2007 | D'Arrigo | F02M 51/0603 239/533.11 |
| 2008/0283634 | A1* | 11/2008 | Hlousek | F02M 47/027 239/585.5 |

* cited by examiner

INJECTION VALVE

CROSS-REFERENCE TO RELATED APPLICATIONS

This patent application claims the priority of German Patent Application No. 10 2012 207 842.8 filed on May 10, 2012, the disclosure of which is hereby incorporated by reference.

TECHNICAL FIELD

The invention relates to an injection valve.

BACKGROUND

Ever stricter legal requirements in respect of the permissible pollutant emissions from internal combustion engines arranged in motor vehicles make it necessary to take various measures by means of which pollutant emissions are reduced. One starting point here is to reduce the pollutant emissions produced by the internal combustion engine.

An appropriate improvement in mixture preparation can be achieved if the fuel is metered in under very high pressure. In the case of gasoline internal combustion engines, fuel pressures are up to 300 bar, e.g. about 200 bar. Such high pressures impose severe demands both on the material of the injection valve and on the construction thereof. Moreover, large forces must be absorbed by the injection valve.

SUMMARY

One embodiment provides an injection valve having a nozzle body with a longitudinal axis, in which a nozzle body aperture and at least one injection opening are arranged, wherein the nozzle body aperture can be coupled hydraulically to a high-pressure circuit for a fluid; at least one nozzle needle arranged in an axially movable manner in the nozzle body aperture, wherein the nozzle needle prevents fluid flow through the at least one injection opening in a closing position and allows fluid flow through the at least one injection opening outside the closing position; and an actuator housing, which is designed to accommodate an actuator designed to act on the nozzle needle, and at least one fluid line, which is designed for hydraulic coupling to the high-pressure circuit for the fluid and is constructed and arranged separately from the actuator housing, and is directly coupled hydraulically to the nozzle body aperture.

In a further embodiment, the injection valve has at least two fluid lines, which are arranged separately from the actuator housing and are directly coupled hydraulically to the nozzle body aperture and are coupled hydraulically to a common hydraulic connection element designed for hydraulic coupling to the high-pressure circuit for the fluid.

In a further embodiment, the hydraulic connection element is arranged substantially coaxially with the actuator housing and the nozzle body.

In a further embodiment, a fluid reservoir is formed in at least one of the fluid lines and/or the hydraulic connection element.

In a further embodiment, the at least one fluid line extends in the axial direction at the side of the actuator housing, from the nozzle body to an electric interface of the injection valve, which is arranged at the opposite end of the actuator housing from the nozzle body.

In a further embodiment, the nozzle body, the actuator housing, an electric interface for connection of the actuator and a hydraulic connection element of the fluid line follow one another in this order in the direction of the longitudinal axis.

BRIEF DESCRIPTION OF THE DRAWINGS

Example embodiments of the invention are explained in greater detail below with reference to the schematic drawings, in which.

DETAILED DESCRIPTION

Figure 1:
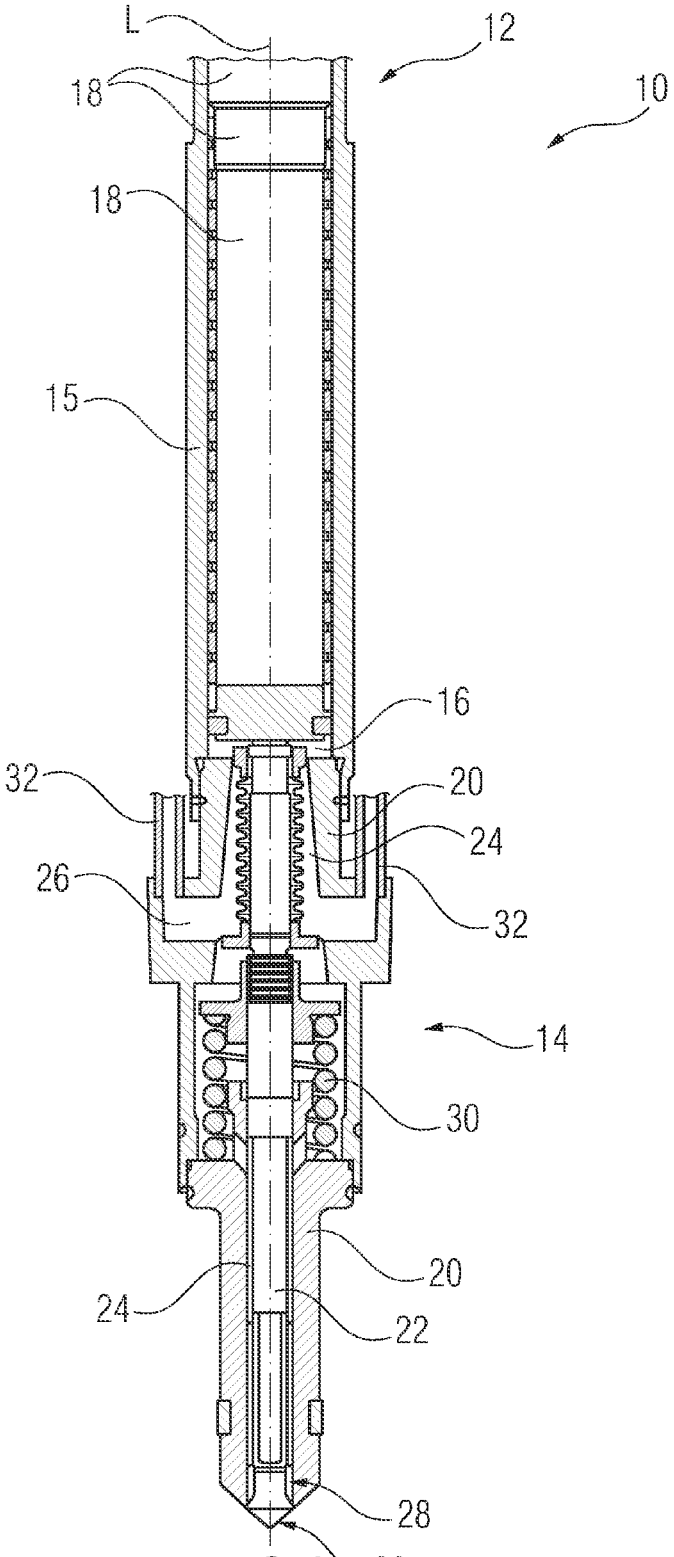
FIG. 1 shows an injection valve in a longitudinal section.

Some embodiments provide an injection valve which is of simple construction and allows reliable and precise operation.

According to one embodiment, an injection valve is specified. The injection valve has a nozzle body with a longitudinal axis, in which a nozzle body aperture and at least one injection opening are arranged. The nozzle body aperture can be coupled hydraulically to a high-pressure circuit for a fluid.

The injection valve furthermore has at least one nozzle needle arranged in an axially movable manner in the nozzle body aperture and having a longitudinal axis, wherein the nozzle needle prevents fluid flow through the at least one injection opening in a closing position and allows fluid flow through the at least one injection opening outside the closing position.

The injection valve furthermore has an actuator housing, which is designed to accommodate an actuator designed to act on the nozzle needle, and at least one fluid line, which is designed for hydraulic coupling to the high-pressure circuit for the fluid. The at least one fluid line is constructed and arranged separately from the actuator housing, and is directly coupled hydraulically to the nozzle body aperture.

This arrangement has the advantage that the at least one fluid line can be coupled directly to the nozzle body and can be designed independently of other housing parts of the injection valve, in particular of the actuator housing. A particularly small space requirement and a compact construction of the injection valve can furthermore be achieved. In addition, it is possible to save on housing parts of the injection valve. In particular, the injection valve can be of very low-cost design.

In one embodiment, the injection valve has at least two fluid lines, which are arranged separately from the actuator housing and are directly coupled hydraulically to the nozzle body aperture. The at least two fluid lines are coupled hydraulically to a common hydraulic connection element designed for hydraulic coupling to the high-pressure circuit for the fluid. An arrangement of this kind has the advantage that the fluid can be distributed between a plurality of fluid lines in a simple manner. A high flow rate through the fluid lines can thereby be achieved. With at least two fluid lines, it is furthermore possible to achieve particularly good matching of the fluid lines to the existing space conditions.

In another embodiment, the hydraulic connection element is arranged substantially coaxially with the actuator housing and the nozzle body. This allows a space-saving design of the injection valve and particularly good and simple mechanical coupling of the injection valve.

In one embodiment, the at least one fluid line projects or the at least two fluid lines project from the nozzle body in the direction of the longitudinal axis. In a development, it/they extends/extend at the side of the actuator housing, along the longitudinal axis in plan view. In the case of two fluid lines, these are arranged on opposite sides of the actuator housing—in particular relative to the longitudinal axis—in the case of one embodiment. In a development, at least one segment of the fluid line(s), which overlaps axially with the actuator housing, is free-standing. In another development, the fluid lines overlap with the nozzle body, at least in segments, along the longitudinal axis in plan view. In this way, a particularly compact and light design can be achieved.

In one embodiment, the nozzle body, the actuator housing and the hydraulic connection element follow one another in this order in the direction of the longitudinal axis. In a development, the nozzle body, the actuator housing, an electric interface for connection of the actuator and the hydraulic connection element follow one another in this order in the direction of the longitudinal axis. In this way, the injection valve can be connectable in a particularly space-saving manner.

In another embodiment, a fluid reservoir is formed in at least one of the fluid lines and/or the hydraulic connection element. This has the advantage that there is no need for a common fluid reservoir designed as a common rail for a plurality of injection valves. Lines leading to the injection valves can be arranged in a simple manner and be of short design. Moreover, the number of hydraulic connection points can be kept small.

The figures show an injection valve 10, which may be used for application as a fuel injection valve for an internal combustion engine of a vehicle. In the embodiment shown here, the injection valve 10 is designed as a valve which opens outward. In alternative embodiments, it is also possible for the injection valve to be designed as a valve which opens inward.

The injection valve 10 has an actuator unit 12 and a nozzle module 14. The actuator unit 12 has an actuator housing 15 with a housing aperture 16, in which an actuator 18 is arranged.

The actuator 18 is designed as a stroke-type actuator and may be a piezoelectric actuator comprising a stack of piezoelectric elements. The axial extent of the piezoelectric actuator changes in accordance with an applied voltage signal. However, the actuator can also be designed as some other actuator that is known for this purpose and is known to be suitable by a person skilled in the art.

The nozzle module 14 comprises a nozzle body 20, a nozzle needle 22 with a longitudinal axis L and a nozzle body aperture 24. The nozzle body aperture 24 extends in the nozzle body 20. The nozzle needle 22 is arranged in the nozzle body aperture 24 and may be guided therein. The nozzle needle 22 can be activated by the actuator 18.

The injection valve 10 comprises a fluid inlet 26, which is coupled hydraulically to the nozzle body aperture 24. The fluid inlet 26 may be coupled to a high-pressure circuit of an internal combustion engine, in which fuel is stored in a high pressure chamber. A fluid outlet 28 with an injection opening 29 is formed at a free end of the nozzle body aperture 24.

The nozzle body 20 and the nozzle needle 22 serve as a support for a spring 30 arranged between the nozzle body 20 and the nozzle needle 22. The nozzle needle 22 is preloaded by means of the spring 30. The spring 30 exerts a force on the nozzle needle 22 such that fluid flow through the injection opening 29 is prevented when there are no other forces acting on the nozzle needle 22.

When the actuator 18 is actuated, the nozzle needle 22 is moved from the closing position thereof into an open position as the axial extension of the actuator 18 progresses, in which open position it allows at least partial fluid flow through the injection opening 29.

The nozzle needle 22 interacts with the nozzle body 20 in such a way that, in a closing position, the nozzle needle 22 prevents fluid flow through the at least one injection opening and, outside the closing position, allows fluid flow through the at least one injection opening 29. In the closing position of the nozzle needle 22, at least one contact line is formed between the nozzle body 20 and the nozzle needle 22, preventing flow through the injection opening 29.

Figure 2:
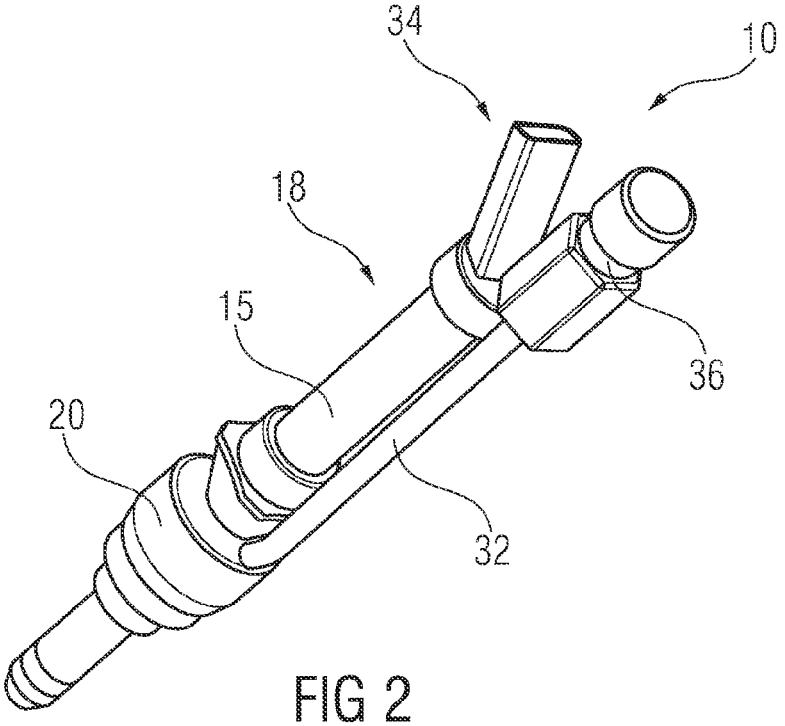
FIG. 2 shows a perspective view of a first embodiment of the injection valve.

The injection valve 10 has at least one fluid line 32, which is designed for hydraulic coupling to the high-pressure circuit for the fluid. In the embodiment in FIG. 2, the injection valve has a fluid line 32, while the embodiments in FIGS. 1, 3 and 4 exhibit two fluid lines 32. In further embodiments, the injection valve 10 can also have more than two fluid lines.

The at least one fluid line 32 is directly coupled hydraulically to the nozzle body aperture 24. For this purpose, the fluid line 32 is connected directly to the nozzle body 20. Moreover, the at least one fluid line 32 is constructed separately from the actuator housing 15. As a result, the actuator housing 15 is separated from the hydraulic interface of the injection valve 10. The actuator housing 15 can thus be limited to the accommodation of the actuator 18 and coupling to an electric interface 34. Moreover, an injector housing designed to accommodate the actuator unit 12, the electric interface 34 and a hydraulic interface can be eliminated. A very compact construction of the injection valve 10 and a small space requirement for the injection valve 10 can thereby be achieved. Moreover, the injection valve 10 can be of low-cost design.

The fluid line 32 extends in the axial direction at the side of the actuator housing 15, from the nozzle body 20 to an electric interface 34 of the injection valve, which is arranged at the opposite end of the actuator housing 15 from the nozzle body. The nozzle body 20, the actuator housing 15 and a hydraulic connection element 36 follow one another in this order along the longitudinal axis L.

Figure 3:
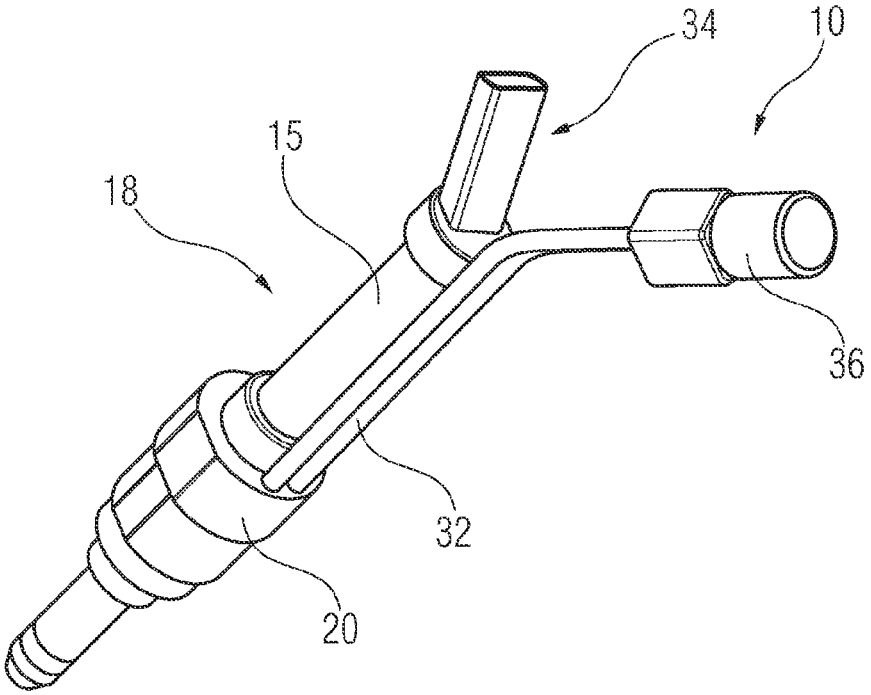
FIG. 3 shows a perspective view of another embodiment of the injection valve.
Figure 4:
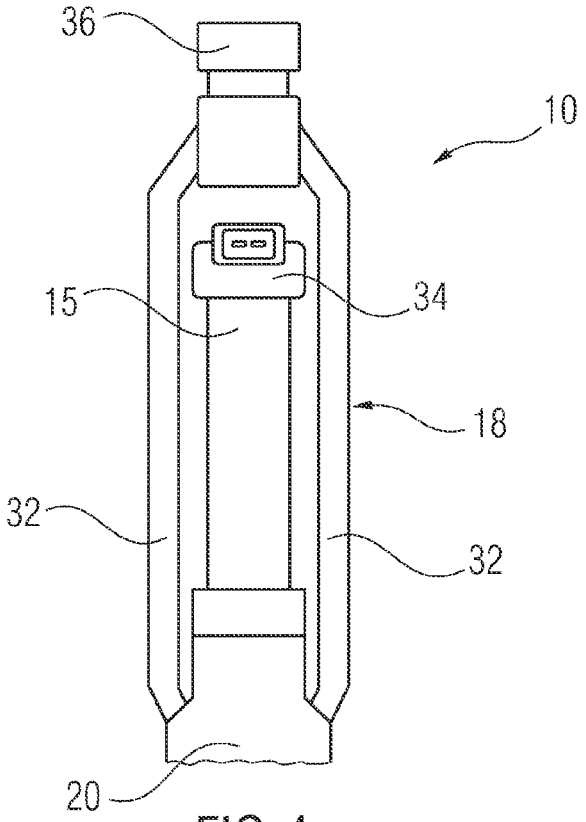
FIG. 4 shows a view of another embodiment of the injection valve.
Figure 5:
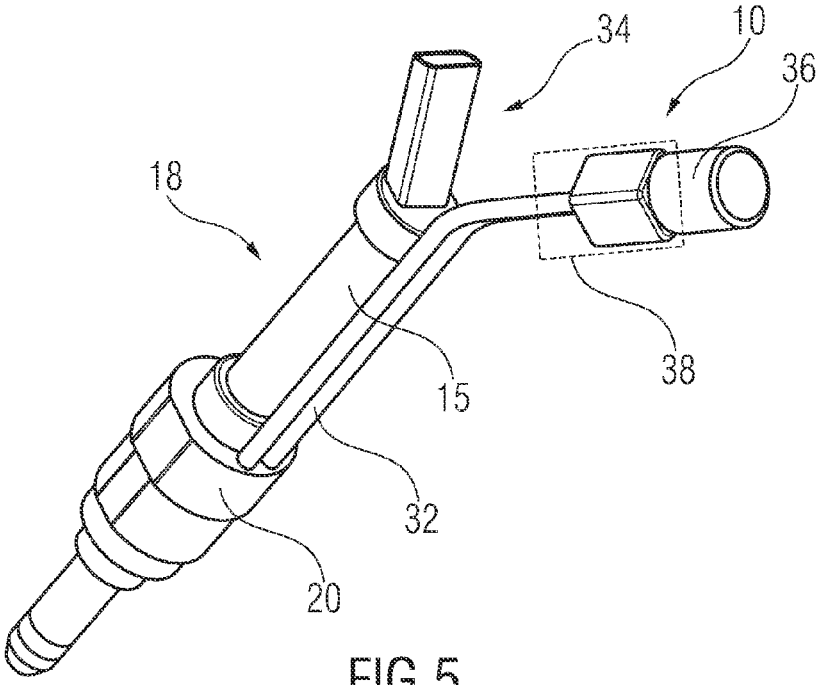
FIG. 5 shows a perspective view of another embodiment of the injection valve.

FIGS. 3, 4 and 5 show embodiments of the injection valve 10 with two fluid lines 32, which are coupled hydraulically to a common hydraulic connection element 36. The common hydraulic connection element 36 is designed for hydraulic coupling of the injection valve 10 to the high-pressure circuit for the fluid. As a result, the injection valve 10 can be of particularly space-saving design. The fluid lines 32 have segments that are parallel to one another, which extend away from the nozzle body 20 in the axial direction along the actuator housing 15.

In the embodiments in FIGS. 3 and 5, the fluid lines 32 bend at the level of the electric interface 34 and extend toward the common hydraulic connection element 36 at an angle to the longitudinal axis. A design of this kind can be implemented at particularly low cost.

In the embodiment of the injection valve 10 which is shown in FIG. 4, the common hydraulic connection element 36 is arranged coaxially with the actuator housing 15 and the nozzle body 20, in relation to the longitudinal axis L. The mutually parallel segments of the fluid lines 32 extend parallel to the longitudinal axis and away from the nozzle body 20, past the electric interface 34. On the side of the electric interface 34 remote from the nozzle body 20, the fluid lines 32 extend toward one another in the direction of the common hydraulic connection element 36, at an angle to the longitudinal axis. Such an embodiment of the injection valve 10 can be particularly space-saving. It is furthermore possible to use the pressure of the fluid acting on the injection valve 10 via the common hydraulic connection element 36 to contribute to reliable retention of the injection valve 10 in the internal combustion engine.

In an embodiment of the injection valve 10 which is shown in FIG. 5, the fluid lines 32 and/or the common hydraulic connection element 36 are designed in such a way that they form an additional fluid reservoir 38. In this way, the injection valve 10 itself can contribute to storage of fluid, in particular fuel, and it may be possible to dispense with a joint common rail for the injection valves of an internal combustion engine.

The invention is not restricted to the illustrative embodiments by the description given with reference to the latter. On the contrary, the invention encompasses any novel feature and any combination of features, including especially any combination of features in the illustrative embodiments and patent claims.

What is claimed is:

1. An injection valve comprising:

a nozzle body having a longitudinal axis and comprising a fluid inlet in fluid communication with a nozzle body aperture, and at least one injection opening, wherein the fluid inlet is hydraulically connectable to a high-pressure circuit for a fluid, at least one nozzle needle arranged in the nozzle body aperture in an axially movable manner, wherein the nozzle needle is configured to prevent fluid flow through the at least one injection opening in a closing position and configured to allow fluid flow through the at least one injection opening in a non-closing position, an actuator moving the at least one nozzle needle between the closing position and the non-closing position, the actuator disposed in an actuator housing separate from the nozzle body, and at least two fluid lines configured for coupling the fluid inlet to the high-pressure circuit for the fluid, the at least two fluid lines arranged separate from the actuator housing and directly hydraulically coupled to the nozzle body aperture through the fluid inlet.

2. The injection valve of claim 1, wherein the fluid inlet is arranged substantially coaxially with the actuator housing and the nozzle body.

3. The injection valve of claim 1, wherein a fluid reservoir is formed in at least one element of the group consisting of the fluid lines and the hydraulic connection element.

4. The injection valve of claim 1, wherein each of the at least two fluid lines extend in an axial direction parallel to the longitudinal axis of the nozzle body and located at a side of the actuator housing, from the nozzle body to an electric interface of the injection valve arranged at an opposite end of the actuator housing from the nozzle body.

5. The injection valve of claim 1, wherein the nozzle body, the actuator housing, an electric interface for connection of the actuator, and the fluid inlet are arranged in order in the direction of the longitudinal axis.

6. An internal combustion engine, comprising:

a high-pressure circuit comprising a high pressure chamber configured to store fuel, and an injection valve comprising:

a nozzle body having a longitudinal axis, a fluid inlet, a nozzle body aperture, and at least one injection opening, wherein the nozzle body aperture is hydraulically connected to the fluid inlet, at least one nozzle needle arranged in the nozzle body aperture in an axially movable manner, wherein the nozzle needle is configured to prevent fluid flow through the at least one injection opening in a closing position and configured to allow fluid flow through the at least one injection opening in a non-closing position, an actuator housing connected to the nozzle body, an actuator disposed in the actuator housing and configured to act on the nozzle needle, and at least two fluid lines coupling the high-pressure circuit for the fluid to directly to the fluid inlet, the at least two fluid lines arranged separate from the actuator housing.

7. The internal combustion engine of claim 6, wherein the hydraulic connection element is arranged substantially coaxially with the actuator housing and the nozzle body.

8. The internal combustion engine of claim 6, wherein a fluid reservoir is formed in at least one element of the group consisting of the fluid lines and the hydraulic connection element.

9. The internal combustion engine of claim 6, wherein each of the at least two fluid lines extend in an axial direction parallel to the longitudinal axis of the nozzle body and located at a side of the actuator housing, from the nozzle body to an electric interface of the injection valve arranged at an opposite end of the actuator housing from the nozzle body.

10. The internal combustion engine of claim 6, wherein the nozzle body, the actuator housing, an electric interface for connection of the actuator, and a hydraulic connection element of the fluid line are arranged in order in the direction of the longitudinal axis.

* * * * *